US010388218B2

(12) United States Patent
Dong

(10) Patent No.: US 10,388,218 B2
(45) Date of Patent: Aug. 20, 2019

(54) PIXEL CIRCUIT, DISPLAY PANEL AND DRIVING METHOD THEREOF

(71) Applicant: BOE Technology Group Co., Ltd., Beijing (CN)

(72) Inventor: Tian Dong, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 15/558,121

(22) PCT Filed: Feb. 28, 2017

(86) PCT No.: PCT/CN2017/075191
§ 371 (c)(1),
(2) Date: Sep. 13, 2017

(87) PCT Pub. No.: WO2017/215290
PCT Pub. Date: Dec. 21, 2017

(65) Prior Publication Data
US 2019/0005877 A1 Jan. 3, 2019

(51) Int. Cl.
*G09G 3/3233* (2016.01)
*G09G 3/3266* (2016.01)
(Continued)

(52) U.S. Cl.
CPC ..... *G09G 3/3233* (2013.01); *G09G 3/3208* (2013.01); *G09G 3/3266* (2013.01);
(Continued)

(58) Field of Classification Search
CPC ..... G09G 3/3233; G09G 2320/0233; G09G 2320/045; G09G 3/3258; G09G 3/3291;
(Continued)

(56) References Cited

U.S. PATENT DOCUMENTS

2008/0106504 A1 5/2008 Wei et al.
2010/0127955 A1 5/2010 Choi
(Continued)

FOREIGN PATENT DOCUMENTS

CN 103440840 A 12/2013
CN 104036725 A 9/2014
(Continued)

OTHER PUBLICATIONS

May 22, 2017—(WO) International Search Report and Written Opinion PCT/CN2017/075191 with English Tran.
(Continued)

*Primary Examiner* — Hong Zhou
(74) *Attorney, Agent, or Firm* — Banner & Witcoff, Ltd.

(57) ABSTRACT

A pixel circuit, a display panel and a driving method are described. The pixel circuit includes: a light-emitting circuit configured for emitting light during a working period; a driving circuit configured for driving the light-emitting circuit; a compensating circuit configured for compensating the driving circuit; a data writing circuit configured for writing data to the driving circuit; a reset circuit configured for resetting the compensating circuit and the driving circuit; a first light-emitting control circuit configured for controlling ON and OFF of the light-emitting circuit.

19 Claims, 6 Drawing Sheets

(51) Int. Cl.
*G09G 3/3291* (2016.01)
*G09G 3/3208* (2016.01)

(52) U.S. Cl.
CPC ..... *G09G 3/3291* (2013.01); *G09G 2300/043* (2013.01); *G09G 2300/0819* (2013.01); *G09G 2320/0233* (2013.01)

(58) Field of Classification Search
CPC ... G09G 2300/0842; G09G 2300/0439; G09G 2310/0202; G09G 2310/0251; G09G 2310/061
See application file for complete search history.

(56) References Cited

U.S. PATENT DOCUMENTS

| | | | | |
|---|---|---|---|---|
| 2014/0300281 | A1* | 10/2014 | Chaji | G09G 3/3233 315/161 |
| 2015/0356924 | A1* | 12/2015 | Chen | G09G 3/3233 345/690 |
| 2016/0253958 | A1* | 9/2016 | Ma | G09G 3/3225 345/211 |
| 2016/0275854 | A1* | 9/2016 | Wang | G09G 3/3233 |
| 2016/0275861 | A1 | 9/2016 | Yang et al. | |
| 2016/0275866 | A1 | 9/2016 | Liu et al. | |
| 2017/0116918 | A1 | 4/2017 | Dong et al. | |
| 2017/0169761 | A1 | 6/2017 | Ma | |
| 2017/0263180 | A1 | 9/2017 | Zhu | |

FOREIGN PATENT DOCUMENTS

| | | | | |
|---|---|---|---|---|
| CN | 104050917 | A | 9/2014 | |
| CN | 104078005 | * | 10/2014 | G09G 3/3225 |
| CN | 104809989 | A | 7/2015 | |
| CN | 104835452 | A | 8/2015 | |
| CN | 105096831 | A | 11/2015 | |
| CN | 105096838 | A | 11/2015 | |
| CN | 105448234 | A | 3/2016 | |
| CN | 105845081 | A | 8/2016 | |
| TW | 200822787 | A | 5/2008 | |

OTHER PUBLICATIONS

Oct. 10, 2016—(CN) Search Report Appn 201610407475.1 with English Tran.
Dec. 6, 2016—(CN) First Office Action Appn 201610407475.1 with English Tran.
Mar. 28, 2017—(CN) Second Office Action Appn 201610407475.1 with English Tran.

* cited by examiner

PIXEL CIRCUIT, DISPLAY PANEL AND DRIVING METHOD THEREOF

The application is a U.S. National Phase Entry of International Application No. PCT/CN2017/05191 filed on Feb. 28, 2017, designating the United States of America and claiming priority to Chinese Patent Application No. 201610407475.1, filed Jun. 12, 2016. The present application claims priority to and the benefit of the above-identified applications and the above-identified applications are incorporated by reference herein in their entirety.

TECHNICAL FIELD

Embodiment of the present disclosure relate to a pixel circuit, a display panel and a driving method thereof.

BACKGROUND

In the display filed, organic light-emitting diode (OLED) display panels have the characteristics such as self-luminous, high contrast, thin, wide viewing angle, fast response, capability of implementing as a flexible panel, wide working temperature range, simple manufacturing process, and so on, and therefore shows a promising prospect.

Because of the above characteristics, organic light-emitting diode (OLED) display panels are suitable for any device with display functions, such as mobile phones, display screens, laptops, digital cameras, and instruments.

SUMMARY

An embodiment of the present disclosure provides a pixel circuit, which comprises: a light-emitting circuit configured for emitting light during a working period; a driving circuit configured for driving the light-emitting circuit; a compensating circuit configured for compensating the driving circuit; a data writing circuit configured for writing data to the driving circuit; a reset circuit configured for resetting the compensating circuit and the driving circuit; a first light-emitting control circuit configured for controlling ON and OFF of the light-emitting circuit; a first voltage terminal and a second voltage terminal configured for providing light-emitting voltages for the light-emitting circuit; a reset voltage terminal configured for providing a resetting voltage for the reset circuit; a reference voltage terminal configured for providing a compensating voltage for the compensating circuit; a scan control terminal configured for providing a signal that controls ON and OFF of the compensating circuit and the data writing circuit; a data signal terminal configured for providing a data signal for the data writing circuit; a reset control terminal configured for providing a signal that controls ON and OFF of the reset circuit; and a first light-emitting control terminal configured for providing a signal that controls ON and OFF of the first light-emitting control circuit.

For example, in the pixel circuit provided by an embodiment of the present disclosure, the compensating circuit comprises a first transistor and a storage capacitor connected in series; the data writing circuit comprises a second transistor and a third transistor connected in series; the reset circuit comprises a fourth transistor, the driving circuit comprises a fifth transistor, the first light-emitting control circuit comprises a sixth transistor, and the light-emitting circuit comprises an organic light-emitting diode.

For example, in the pixel circuit provided by an embodiment of the present disclosure, a source of the first transistor is electrically connected with the reference voltage terminal, a gate of the first transistor is electrically connected with the scan control terminal, and a drain of the first transistor is electrically connected with a first node; a source of the second transistor is electrically connected with the data signal terminal, a gate of the second transistor is electrically connected with the scan control terminal, and a drain of the second transistor is electrically connected with a source of the third transistor; a gate of the third transistor is electrically connected with a drain of the third transistor, and the drain of the third transistor is electrically connected with a second node; a source of the fourth transistor is electrically connected with the reset voltage terminal, a gate of the fourth transistor is electrically connected with the reset control terminal, and a drain of the fourth transistor is electrically connected with the second node; a source of the fifth transistor is electrically connected with the first node, and a gate of the fifth transistor is electrically connected with the second node; a source of the sixth transistor is electrically connected with the first voltage terminal, a gate of the sixth transistor is electrically connected with the first light-emitting control terminal, and a drain of the sixth transistor is electrically connected with the first node; a first terminal of the storage capacitor is electrically connected with the first node, and a second terminal of the storage capacitor is electrically connected with the second node; a first terminal of the organic light-emitting diode is electrically connected with a drain of the fifth transistor, and a second terminal of the organic light-emitting diode is electrically connected with the second voltage terminal.

For example, in the pixel circuit provided by an embodiment of the present disclosure, a second light-emitting control circuit configured for controlling ON and OFF of the light-emitting circuit; and a second light-emitting control terminalsecond light-emitting control terminal configured for providing a signal that controls ON and OFF of the second light-emitting control circuit.

For example, in the pixel circuit provided by an embodiment of the present disclosure, the first light-emitting control terminal and the second light-emitting control terminalsecond light-emitting control terminal are electrically connected with each other.

For example, in the pixel circuit provided by an embodiment of the present disclosure, the compensating circuit comprises a first transistor and a storage capacitor, the data writing circuit comprises a second transistor and a third transistor connected in series, the reset circuit comprises a fourth transistor, the driving circuit comprises a fifth transistor, the first light-emitting control circuit comprises a sixth transistor, the second light-emitting control circuit comprises a seventh transistor, and the light-emitting circuit comprises an organic light-emitting diode.

For example, in the pixel circuit provided by an embodiment of the present disclosure, a source of the first transistor is electrically connected with the reference voltage terminal, a gate of the first transistor is electrically connected with the scan control terminal, and a drain of the first transistor is electrically connected with a first node; a source of the second transistor is electrically connected with the data signal terminal, a gate of the second transistor is electrically connected with the scan control terminal, and a drain of the second transistor is electrically connected with a source of the third transistor; a gate of the third transistor is electrically connected with a drain of the third transistor, and the drain of the third transistor is electrically connected with a second node; a source of the fourth transistor is electrically connected with the reset voltage terminal, a gate of the fourth transistor is electrically connected with the reset control terminal, and a drain of the fourth transistor is electrically connected with the second node; a source of the fifth transistor is electrically connected with the first node, and a gate of the fifth transistor is electrically connected with the second node; a source of the sixth transistor is electrically connected with the first voltage terminal, a gate of the sixth transistor is electrically connected with the first light-emitting control terminal, and a drain of the sixth transistor is electrically connected with the first node; a first terminal of the storage capacitor is electrically connected with the first node, and a second terminal of the storage capacitor is electrically connected with the second node; a source of the seventh transistor is electrically connected with a drain of the fifth transistor, a gate of the seventh transistor is electrically connected with the second light-emitting control terminalsecond light-emitting control terminal, a first terminal of the organic light-emitting diode is electrically connected with a drain of the seventh transistor, and a second terminal of the organic light-emitting diode is electrically connected with the second voltage terminal; or, a first terminal of the organic light-emitting diode is electrically connected with a drain of the fifth transistor, a second terminal of the organic light-emitting diode is electrically connected with a source of the seventh transistor, a gate of the seventh transistor is electrically connected with the second light-emitting control terminalsecond light-emitting control terminal, and a drain of the seventh transistor is electrically connected with the second voltage terminal.

For example, in the pixel circuit provided by an embodiment of the present disclosure, a threshold voltage of the third transistor and a threshold voltage of the fifth transistor are equal to each other.

For example, in the pixel circuit provided by an embodiment of the present disclosure, the first transistor, the second transistor, the third transistor, the fourth transistor, the fifth transistor, the sixth transistor and the seventh transistor are thin-film transistors.

For example, in the pixel circuit provided by an embodiment of the present disclosure, the first transistor, the second transistor, the third transistor, the fourth transistor, the fifth transistor, the sixth transistor and the seventh transistor are P-type transistors.

An embodiment of the present disclosure further provides a display panel, which comprises the pixel circuits provided by any one of the embodiment of the present disclosure.

An embodiment of the present disclosure further provides a driving method for the pixel circuit; the pixel circuits comprises: a light-emitting circuit configured for emitting light during a working period; a driving circuit configured for driving the light-emitting circuit; a compensating circuit configured for compensating the driving circuit; a data writing circuit configured for writing data to the driving circuit; a reset circuit configured for resetting the compensating circuit and the driving circuit; a first light-emitting control circuit configured for controlling ON and OFF of the light-emitting circuit; a first voltage terminal and a second voltage terminal configured for providing light-emitting voltages for the light-emitting circuit; a reset voltage terminal configured for providing a resetting voltage for the reset circuit; a reference voltage terminal configured for providing a compensating voltage for the compensating circuit; a scan control terminal configured for providing a signal that controls ON and OFF of the compensating circuit and the data writing circuit; a data signal terminal configured for providing a data signal for the data writing circuit; a reset control terminal configured for providing a signal that controls ON and OFF of the reset circuit; a first light-emitting control terminal configured for providing a signal that controls ON and OFF of the first light-emitting control circuit; the driving method comprises a resetting phase, a threshold compensating and data writing phase, and an IR drop compensating and light emitting phase.

For example, in the driving method provided by an embodiment of the present disclosure, during the resetting phase, the reset control terminal outputs a valid signal, the scan control terminal outputs an invalid signal, and the first light-emitting control terminal outputs an invalid signal.

For example, in the driving method provided by an embodiment of the present disclosure, during the threshold compensating and data writing phase, the reset control terminal outputs an invalid signal, the scan control terminal outputs a valid signal, and the first light-emitting control terminal outputs an invalid signal.

For example, in the driving method provided by an embodiment of the present disclosure, during the IR drop compensating and light emitting phase, the reset control terminal outputs an invalid signal, the scan control terminal outputs an invalid signal, and the first light-emitting control terminal outputs a valid signal.

An embodiment of the present disclosure further provide a driving method for the pixel circuit; the pixel circuits comprises: a light-emitting circuit configured for emitting light during a working period; a driving circuit configured for driving the light-emitting circuit; a compensating circuit configured for compensating the driving circuit; a data writing circuit configured for writing data to the driving circuit; a reset circuit configured for resetting the compensating circuit and the driving circuit; a first light-emitting control circuit configured for controlling ON and OFF of the light-emitting circuit; a first voltage terminal and a second voltage terminal configured for providing light-emitting voltages for the light-emitting circuit; a reset voltage terminal configured for providing a resetting voltage for the reset circuit; a reference voltage terminal configured for providing a compensating voltage for the compensating circuit; a scan control terminal configured for providing a signal that controls ON and OFF of the compensating circuit and the data writing circuit; a data signal terminal configured for providing a data signal for the data writing circuit; a reset control terminal configured for providing a signal that controls ON and OFF of the reset circuit; a first light-emitting control terminal configured for providing a signal that controls ON and OFF of the first light-emitting control circuit; a second light-emitting control circuit configured for controlling ON and OFF of the light-emitting circuit; and a second light-emitting control terminalsecond light-emitting control terminal configured for providing a signal that controls ON and OFF of the second light-emitting control circuit; the driving method comprises a resetting phase, a threshold compensating and data writing phase, and an IR drop compensating and light emitting phase.

For example, in the driving method provided by an embodiment of the present disclosure, during the resetting phase, the reset control terminal outputs a valid signal, the scan control terminal outputs an invalid signal, and the first light-emitting control terminal and the second light-emitting control terminalsecond light-emitting control terminal outputs an invalid signal.

For example, in the driving method provided by an embodiment of the present disclosure, during the threshold compensating and data writing phase, the reset control terminal outputs an invalid signal, the scan control terminal outputs a valid signal, and the first light-emitting control terminal and the second light-emitting control terminalsecond light-emitting control terminal outputs an invalid signal.

For example, in the driving method provided by an embodiment of the present disclosure, during the IR drop compensating and light emitting phase, the reset control terminal outputs an invalid signal, the scan control terminal outputs an invalid signal, and the first light-emitting control terminal and the second light-emitting control terminalsecond light-emitting control terminal outputs a valid signal.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

Figure 1:
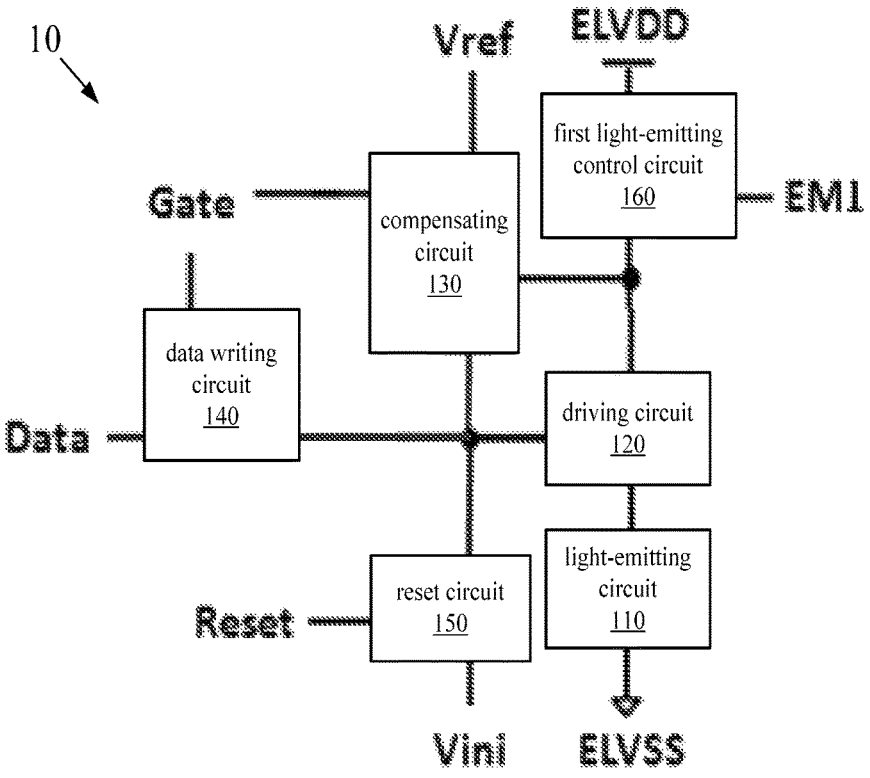
FIG. 1 is a first schematic diagram of a pixel circuit provided by an embodiment of the present disclosure.

In the following, technical solutions of the embodiments of the present disclosure will be described in a clearly and fully understandable way in connection with the drawings; with reference to the non-limiting exemplary embodiments, which are illustrated in the drawings and detailed described in the following, the exemplary embodiments and the features and favorable details of the present disclosure will be described more comprehensively. It should be noted that the features in the drawings are not necessarily illustrated in proportion. The present disclosure omits the descriptions of known materials, components, and processing technologies to avoid the vagueness occurring to the exemplary embodiments of the present disclosure. The examples are intended for helping understand the implementation methods of the embodiments of the present disclosure, such that those skilled in the art can implement the exemplary embodiments. Therefore, those examples are not limitative of the scope of the embodiment of the present disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. In addition, in the embodiments of the present disclosure, identical or similar numerals represent identical or similar components.

IR drop phenomenon can occurs in organic light-emitting diode (OLED) display panels; IR drop phenomenon is caused by the voltage division of the resistive component of wires of the display panel, that is, according to Ohm's law, wires can cause voltage drop to a certain degree upon an electrical current flowing through the wires. Therefore, impacts of the IR drop upon the pixel units at different locations are different, which can cause inhomogeneity to displayed images of the display panel. Therefore, IR drop of an OLED display panel needs to be compensated.

In addition, in an OLED display panel, the threshold voltages of the driving transistors of different pixel units may be different because the manufacturing process may fluctuate, and the threshold voltages of the driving transistors can also drift to different values. Therefore, different threshold voltages of the driving transistors can also cause inhomogeneity to displayed images of the display panel. Therefore, the threshold voltages need to be compensated too.

Embodiments of the present disclosure provide a pixel circuit, a display panel and a driving method therefor, IR drop and threshold voltage shifts in a display panel can be compensated, the homogeneity to driving currents can be increased, and the homogeneity to displayed images of the display panel can be accordingly improved.

First Embodiment

For example, as illustrated in FIG. 1, the embodiment of the present disclosure provides a pixel circuit 10, which comprises: a light-emitting circuit 110 configured for emitting light during a working period; a driving circuit 120 configured for driving the light-emitting circuit 110; a compensating circuit 130 configured for compensating the driving circuit 120; a data writing circuit 140 configured for writing data to the driving circuit 120; a reset circuit 150 configured for resetting the compensating circuit 130 and the driving circuit 120; a first light-emitting control circuit 160 configured for controlling ON and OFF of the light-emitting circuit 110; a first voltage terminal ELVDD and a second voltage terminal ELVSS configured for providing light-emitting voltages for the light-emitting circuit 110; a reset voltage terminal Vini configured for providing a resetting voltage for the reset circuit 150; a reference voltage terminal Vref configured for providing a compensating voltage for the compensating circuit 130; a scan control terminal (Gate) configured for providing a signal that controls ON and OFF of the compensating circuit 130 and the data writing circuit 140; a data signal terminal (Data) configured for providing a data signal for the data writing circuit 140; a reset control terminal (Reset) configured for providing a signal that controls ON and OFF of the reset circuit 150; a first light-emitting control terminal EM1 configured for providing a signal that controls ON and OFF of the first light-emitting control circuit 160.

Figure 2:
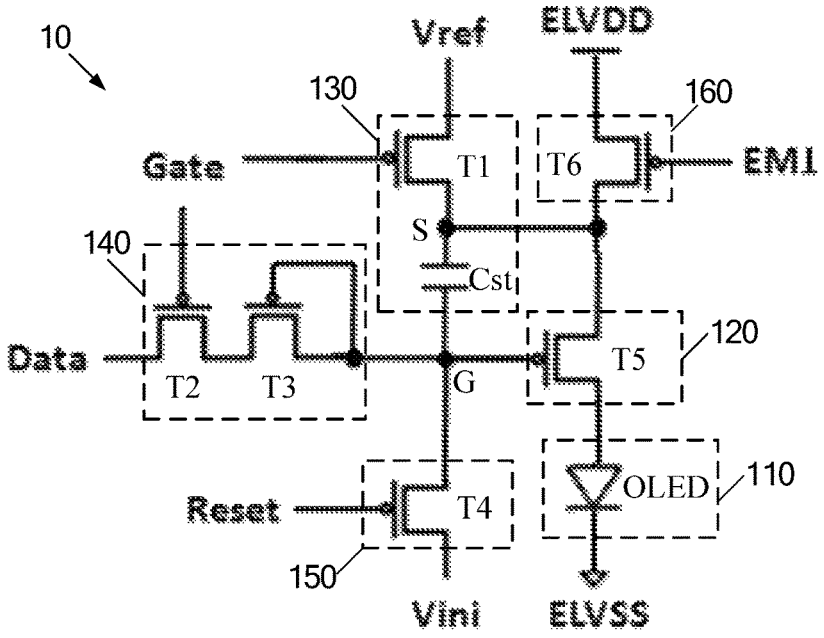
FIG. 2 is a second schematic diagram of a pixel circuit provided by an embodiment of the present disclosure.

For example, as illustrated in FIG. 2, in one concrete example of the pixel circuit 10 provided by the embodiment of the present disclosure, the compensating circuit 130 comprises a first transistor T1 and a storage capacitor Cst connected in series; the data writing circuit 140 comprises a second transistor T2 and a third transistor T3 connected in series; the reset circuit 150 comprises a fourth transistor T4, the driving circuit 120 comprises a fifth transistor T5, the first light-emitting control circuit 160 comprises a sixth transistor T6, the light-emitting circuit 110 comprises an organic light-emitting diode (OLED).

It should be understood that the pixel circuit 10 illustrated in FIG. 2 is only an example to implement the pixel circuit 10 illustrated in FIG. 1, and the embodiment of the present disclosure comprises the pixel circuit illustrated in FIG. 2, but not limited to the above pixel circuit.

For example, as illustrated in FIG. 2, for the convenience of description, a first node S and a second node G are introduced. The first node S and the second node G are intended for describing connections between components, so it is not necessary to refer to real nodes such as solder joint or pad for the pixel circuit 10.

For example, as illustrated in FIG. 2, in the pixel circuit 10 provided by the embodiment of the present disclosure, a source of the first transistor T1 is electrically connected with the reference voltage terminal Vref, a gate of the first transistor T1 is electrically connected with the scan control terminal (Gate), a drain of the first transistor T1 is electrically connected with the first node S; a source of the second transistor T2 is electrically connected with the data signal terminal (Data), a gate of the second transistor T2 is electrically connected with the scan control terminal (Gate), a drain of the second transistor T2 is electrically connected with a source of the third transistor T3; a gate of the third transistor T3 is electrically connected with a drain of the third transistor T3, the drain of the third transistor T3 is electrically connected with the second node G; a source of the fourth transistor T4 is electrically connected with the reset voltage terminal Vini, a gate of the fourth transistor T4 is electrically connected with the reset control terminal (Reset), a drain of the fourth transistor T4 is electrically connected with the second node G; a source of the fifth transistor T5 is electrically connected with the first node S, a gate of the fifth transistor T5 is electrically connected with the second node G; a source of the sixth transistor T6 is electrically connected with the first voltage terminal ELVDD, a gate of the sixth transistor T6 is electrically connected with the first light-emitting control terminal EM1, a drain of the sixth transistor T6 is electrically connected with the first node S; a first terminal of the storage capacitor Cst is electrically connected with the first node S, a second terminal of the storage capacitor Cst is electrically connected with the second node G; a first terminal of the OLED is electrically connected with a drain of the fifth transistor T5, and a second terminal of the OLED is electrically connected with the second voltage terminal ELVSS.

It should be understood that the source and the drain of the transistor provided by the embodiment of the present disclosure are exchangeable.

For example, as illustrated in FIG. 2, the first terminal of the OLED is an anode, and the second terminal of the OLED is a cathode. The first terminal of OLED can be a cathode, and the second terminal of OLED can be an anode according to the voltage provided by the first voltage terminal ELVDD and the second voltage terminal ELVSS.

For example, the gate of the third transistor T3 is electrically connected with the drain of the third transistor T3, and therefore, a structure similar to a diode can be formed.

For example, in the pixel circuit provided by the embodiment of the present disclosure, a threshold voltage of the third transistor T3 and a threshold voltage of the fifth transistor T5 are equal to each other.

For example, in the pixel circuit provided by the embodiment of the present disclosure, the first transistor T1, the second transistor T2, the third transistor T3, the fourth transistor T4, the fifth transistor T5, and the sixth transistor T6 are thin-film transistors (TFT). However, the embodiment of the present disclosure is not limited to the above case; for example, the above transistors can also be field effect transistors instead.

For example, in the pixel circuit provided by the embodiment of the present disclosure, the first transistor T1, the second transistor T2, the third transistor T3, the fourth transistor T4, the fifth transistor T5, and the sixth transistor T6 are P-type transistors.

It should be understood that the embodiment of the present disclosure comprises, but not limited to, the following case, that is, the first transistor T1, the second transistor T2, the third transistor T3, the fourth transistor T4, the fifth transistor T5, and the sixth transistor T6 are P-type transistors. In the embodiment of the present disclosure, part of or all of the transistors can also be N-type transistors, and concrete structures of the transistors can be chosen according to actual demands, and the structure and/or the driving method of the pixel circuit can be modified accordingly.

Figure 4:
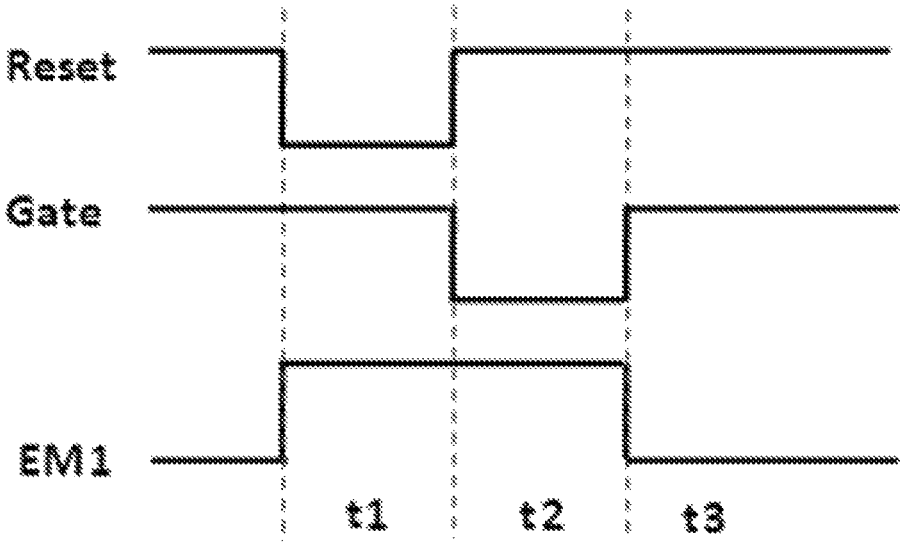
FIG. 4 is a driving timing diagram of the pixel circuit, which is provided by the embodiment of the present disclosure and illustrated in FIG. 2.

For example, the embodiment of the present disclosure further provides a driving method for the pixel circuit; the following descriptions are based on the pixel circuit illustrated in FIG. 2. FIG. 4 is a driving timing diagram, provided by the embodiment of the present disclosure, of the pixel circuit illustrated in FIG. 2. As illustrated in FIG. 4, the driving method comprises a resetting phase t1, a threshold compensating and data writing phase t2, and an IR drop compensating and light emitting phase t3.

For example, in the driving method provided by the embodiment of the present disclosure, during the resetting phase t1, the reset control terminal (Reset) outputs a valid signal, the scan control terminal (Gate) outputs an invalid signal, and the first light-emitting control terminal EM1 outputs an invalid signal.

For example, in the driving method provided by the embodiment of the present disclosure, during the threshold compensating and data writing phase t2, the reset control terminal (Reset) outputs an invalid signal, the scan control terminal (Gate) outputs a valid signal, and the first light-emitting control terminal EM1 outputs an invalid signal.

For example, in the driving method provided by the embodiment of the present disclosure, during the IR drop compensating and light emitting phase t3, the reset control terminal (Reset) outputs an invalid signal, the scan control terminal (Gate) outputs an invalid signal, and the first light-emitting control terminal EM1 outputs a valid signal.

In the present disclosure, "valid signal" refers to a signal which can turn on the transistor after being applied to the gate of the transistor, that is, a signal which can make a path between the source of the transistor and the drain of the transistor be in a conductive state, i.e., a signal which can bring a corresponding circuit to be in a working state. For example, in a case that the transistor is a P-type transistor, the valid signal is a low voltage signal (i.e., a voltage of a signal is lower that a threshold voltage of the transistor); in a case that the transistor is an N-type transistor, the valid signal is a high voltage signal (i.e., a voltage of a signal is higher that a threshold voltage of the transistor).

In the present disclosure, "invalid signal" refers to a signal which can turn off the transistor after being applied to the gate of the transistor, that is, a signal which can make a path between the source of the transistor and the drain of the transistor be in a disconnecting state, i.e., a signal which can bring a corresponding circuit to be in a non-working state. For example, in a case that the transistor is a P-type transistor, the invalid signal is a high voltage signal (i.e., a voltage of a signal is higher that a threshold voltage of the transistor); in a case that the transistor is an N-type transistor, the invalid signal is a low voltage signal (i.e., a voltage of a signal is lower that a threshold voltage of the transistor).

Figure 3A:
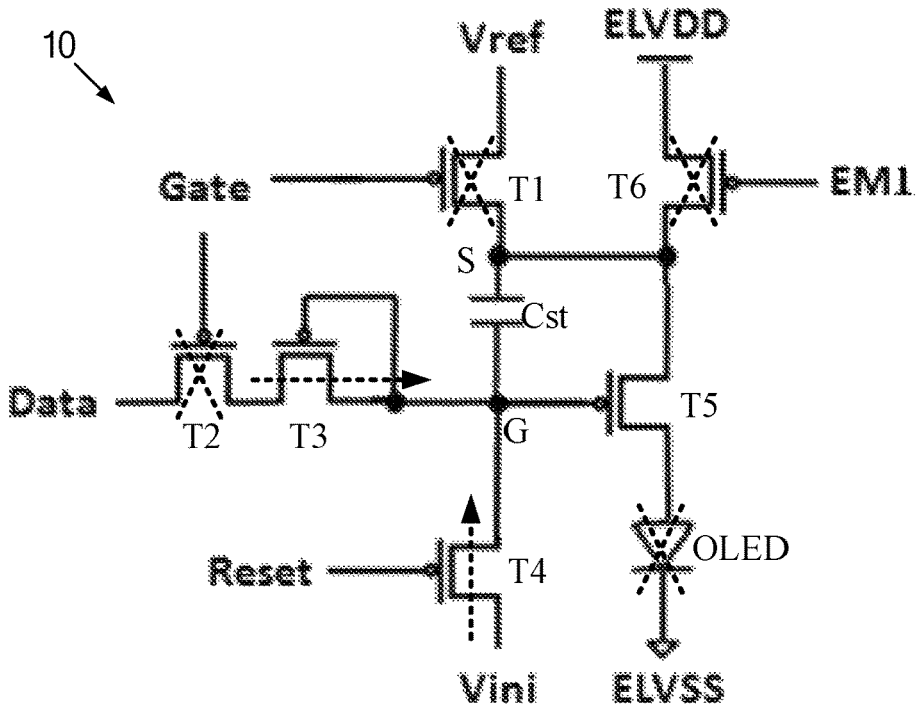
FIG. 3A is a schematic diagram of the turning-on (ON) and turning-off (OFF) states of transistors of the pixel circuit, which is provided by the embodiment of the present disclosure and illustrated in FIG. 2, during a resetting phase.

For example, refer to FIG. 3A and FIG. 4, during the resetting phase t1, the reset control terminal (Reset) outputs a valid signal and therefore makes the fourth transistor T4 be turned on; the scan control terminal (Gate) outputs an invalid signal and therefore the first transistor T1 and the second transistor T2 are turned off; the first light-emitting control terminal EM1 outputs an invalid signal and therefore the sixth transistor T6 is turned off. Because the fourth transistor T4 is turned on, the reset voltage terminal Vini is electrically connected with the second node G via the fourth transistor T4, and therefore the voltage of the second node G is equal to the resetting voltage Vvini provided by the reset voltage terminal, i.e., the voltage of the second terminal of the storage capacitor Cst of the compensating circuit 130 is Vvini, and the voltage of the gate of the fifth transistor T5 of the driving circuit 120 is Vvini, that is, the reset circuit 150 resets the compensating circuit 130 and the driving circuit 120 during the resetting phase t1.

Figure 3B:
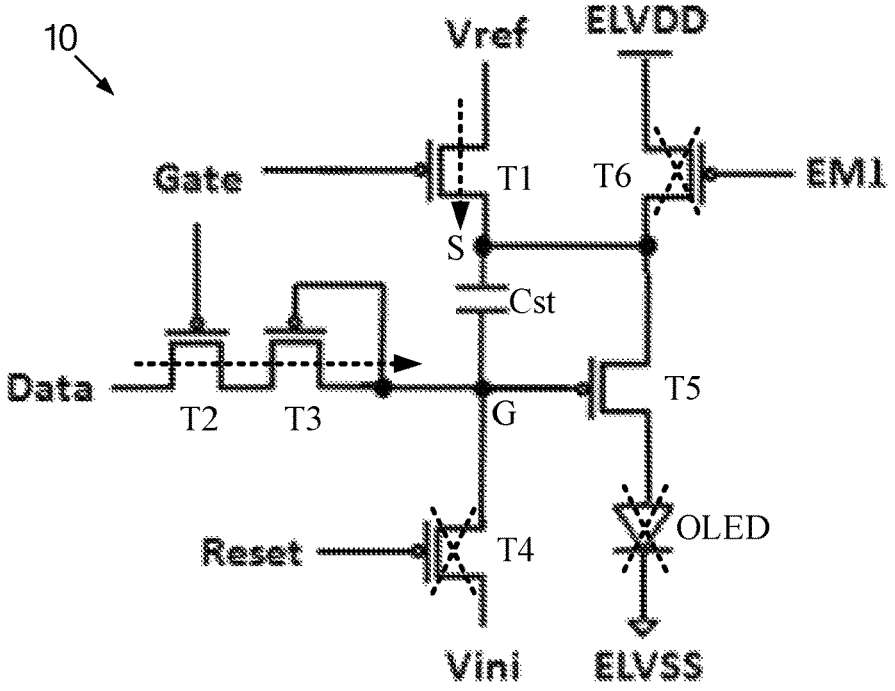
FIG. 3B is a schematic diagram of ON and OFF states of transistors of the pixel circuit, which is provided by the embodiment of the present disclosure and illustrated in FIG. 2, during a threshold compensating and data writing phase.

For example, refer to FIG. 3B and FIG. 4, during the threshold compensating and data writing phase t2, the reset control terminal (Reset) outputs an invalid signal, and therefore the fourth transistor T4 is turned off; the scan control terminal (Gate) outputs a valid signal, and therefore makes the first transistor T1 and the second transistor T2 be turned on; the first light-emitting control terminal EM1 outputs an invalid signal and therefore the sixth transistor T6 is turned off. Because the first transistor T1 is turned on, the reference voltage terminal Vref is electrically connected with the first node S via the first transistor T1, and the voltage of the first node is equal to the compensating voltage Vvref provided by the reference voltage terminal, i.e., the voltage of the first terminal of the storage capacitor Cst of the compensating circuit 130 is Vvref. Because the second transistor T2 is turned on, the data signal terminal (Data) is electrically connected with the second node G via the second transistor T2 and the third transistor T3; in addition, because the gate of the third transistor T3 is electrically connected with the drain of the third transistor T3, the third transistor T3 functions as a diode; therefore, the voltage of the second node G is equal to the sum of the voltage Vdata of the data signal terminal (Data) and the threshold voltage Vth of the third transistor T3, that is, the voltage of the second terminal of the storage capacitor Cst of the compensating circuit 130 is Vdata+Vth, and the voltage of the gate of the fifth transistor T5 of the driving circuit 120 is Vdata+Vth. It should be understood that the voltage of the second node G during the previous phase (resetting phase t1) is equal to the resetting voltage Vvini provided by the reset voltage terminal, and the voltage of the second node G should satisfy the following requirement: Vvini−Vth<Vdata. Thereby, during the threshold compensating and data writing phase t2, the data writing circuit 140 writes a data voltage to the driving circuit 120, and therefore, the threshold voltage compensation is realized; at this moment, the voltage difference between the first terminal and the second terminal of the storage capacitor Cst is Vdata+Vth−Vvref. For example, in a case that both the threshold voltage of the third transistor T3 and the threshold voltage of the fifth transistor T5 are equal to Vth, the voltage of the gate of the fifth transistor T5 is Vdata+Vth; in a case that the threshold voltages of the fifth transistors T5 (i.e., driving transistors) of a plurality of pixel circuits are different from each other, or the threshold voltages of the fifth transistors T5 are shifted, the voltage of the gate of respective driving transistor is equal to the sum of the threshold voltage Vth of the driving transistor and the voltage Vdata of the data signal terminal (Data), that is, the gate of the driving transistor is further applied with the voltage Vdata of the data signal terminal (Data) on the basis of the threshold voltage of the driving transistor being compensated; compared with the case that the threshold voltage of the fifth transistor T5 and the threshold voltage of the third transistor T3 are different, the effect of the threshold voltage compensation of the embodiment can be improved.

Figure 3C:
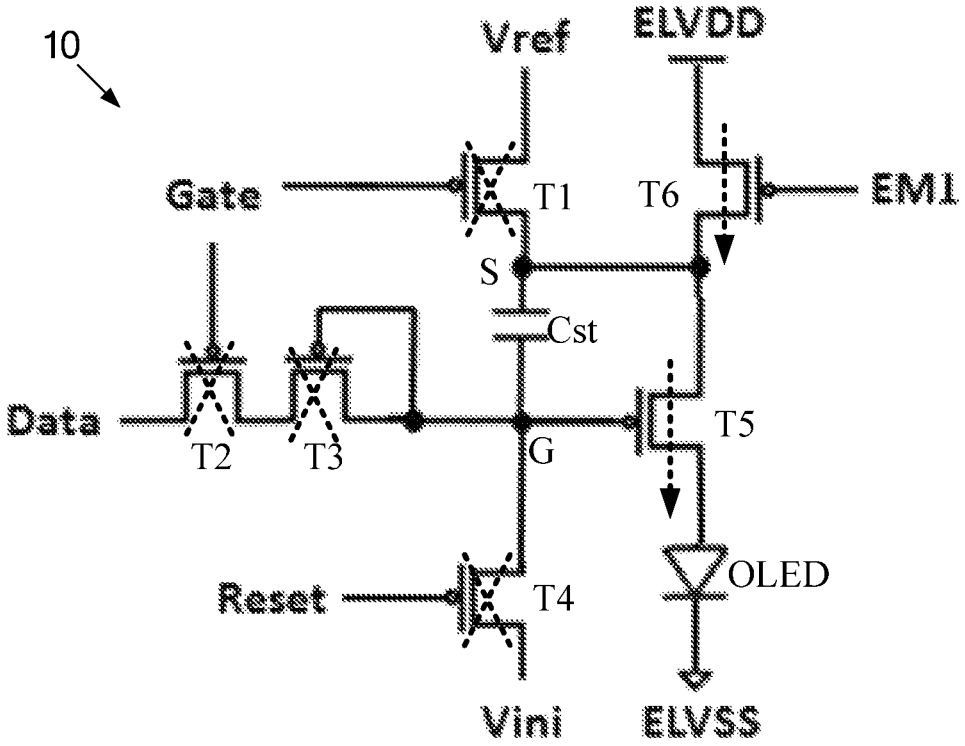
FIG. 3C is a schematic diagram of the ON and OFF states of transistors of the pixel circuit, which is provided by the embodiment of the present disclosure and illustrated in FIG. 2, during a IR drop compensating and light emitting phase.

For example, refer to FIG. 3C and FIG. 4, during the IR drop compensating and light emitting phase t3, the reset control terminal (Reset) outputs an invalid signal, and therefore the fourth transistor T4 is turned off; the scan control terminal (Gate) outputs an invalid signal, and therefore the first transistor T1 and the second transistor T2 are turned off; the first light-emitting control terminal EM1 outputs a valid signal, and therefore the sixth transistor T6 is turned on. An electrical path is formed through the first voltage terminal ELVDD, the sixth transistor T6, the fifth transistor T5, the OLED, and the second voltage terminal ELVSS; the OLED of the light-emitting circuit 110 emits light by means of the light-emitting voltages provided by the first voltage terminal ELVDD and second voltage terminal ELVSS (the first voltage terminal ELVDD provides a first light-emitting voltage Velvdd, and the second voltage terminal ELVSS provides a second light-emitting voltage Velvss) and under the driving of the fifth transistor T5 of the driving circuit 120. Because the sixth transistor T6 is turned on, the first voltage terminal ELVDD is electrically connected with the first node S via the sixth transistor T6, and the voltage of the first node S is changed to the first light-emitting voltage Velvdd provided by the first voltage terminal ELVDD, that is, the voltage of the first terminal of the storage capacitor Cst is Velvdd, and the voltage of the source of the fifth transistor T5 is Velvdd. Because of the self-lifting effect of the storage capacitor Cst, that is, in the case that the electric charge stored by the storage capacitor Cst is not changed, the change of the voltage of the first terminal can result in the change of the voltage of the second terminal, and the voltage difference between the second terminal and the first terminal remains the same, the voltage of the second terminal of the storage capacitor Cst is changed to the sum of the voltage Velvdd of the first terminal of the storage capacitor Cst and the voltage difference Vdata+Vth-Vvref between the second terminal and the first terminal of the storage capacitor Cst, which voltage difference is obtained during the previous phase (threshold compensating and data writing phase t2), that is, the voltage of the second node G is equal to Velvdd+Vdata+Vth−Vvref, and the voltage of the source of the fifth transistor T5 is equal to Velvdd+Vdata+Vth−Vvref. Therefore, the gate-source voltage Vgs (i.e., the voltage difference between the voltage of the gate and the voltage of the source of the fifth transistor T5) of the fifth transistor T5 is satisfying the following equation:

$$Vgs=Velvdd+V\text{data}+Vth-V\text{vref}-Velvdd=V\text{data}+Vth-V\text{vref}$$

The OLED is in saturation state in normal operation, and the driving current holed transmitted through the OLED is satisfying the following equation:

$$Ioled = 0.5\mu_n Cox\frac{W}{L}(Vgs - Vth)^2$$

where μn is the channel mobility of the fifth transistor T5, Cox is the channel capacitance per unit area of the fifth transistor T5, and W and L are the channel width and the channel length of the fifth transistor T5, respectively.

According to the previous calculation result, $$Vgs-Vth=V\text{data}+Vth-V\text{vref}-Vth=V\text{data}-V\text{vref}$$

and therefore, $$Ioled = 0.5\mu_n Cox\frac{W}{L}(Vgs - Vth)^2 = 0.5\mu_n Cox\frac{W}{L}(Vdata - Vvref)^2$$

Based on the above equation, the driving current Ioled flowing through the OLED is irrelevant to all the threshold voltage Vth of the fifth transistor T5, the first light-emitting voltage Velvdd provided by the first voltage terminal ELVDD, and the second light-emitting voltage Velvss provided by the second voltage terminal ELVSS, and the driving current Ioled is only relevant to the voltage Vdata of the data signal terminal (Data) and the compensating voltage Vvref provided by the reference voltage terminal Vref; and therefore the driving current Ioled flowing through the OLED is a constant value as long as the voltage difference between the voltage Vdata of the data signal terminal (Data) and the compensating voltage Vvref provided by the reference voltage terminal Vref remains a constant value. Therefore, the threshold voltage and IR drop can be compensated, the homogeneity of driving current can be improved, and the homogeneity of displayed images of the display panel can be accordingly improved.

For example, in an embodiment of the present disclosure, the first light-emitting voltage Velvdd provided by the first voltage terminal ELVDD, the second light-emitting voltage Velvss provided by the second voltage terminal ELVSS, the compensating voltage Vvref provided by the reference voltage terminal Vref, and the resetting voltage provided by the reset voltage terminal Vini are constant voltages.

For example, in an example of the embodiment of the present disclosure, Velvdd=8V, Velvss=−1V, Vvref=4V, Vvini=−3V, Vdata=3V, and Cst=0.35 PF.

Second Embodiment

Figure 5:
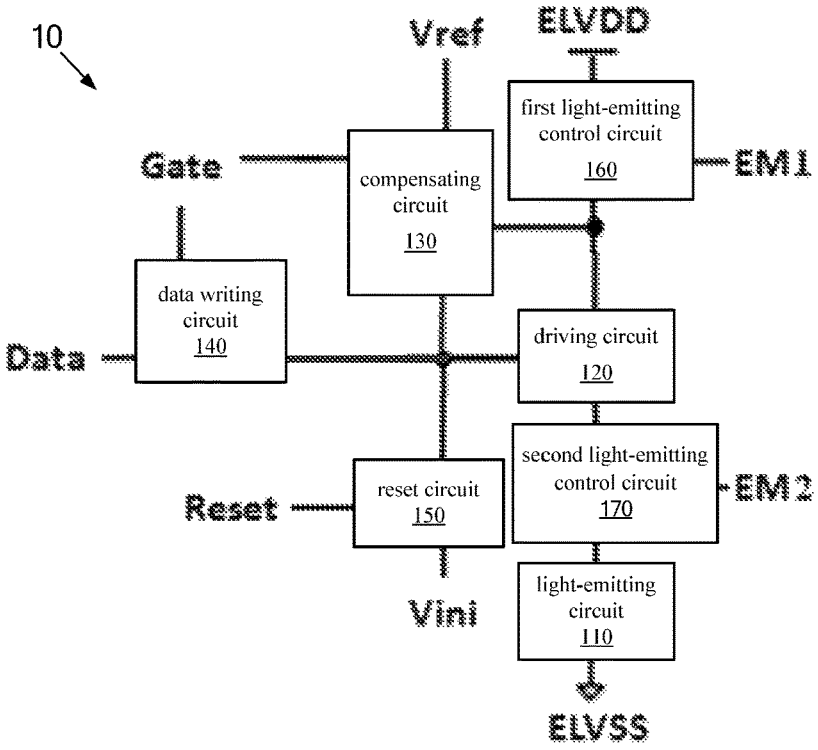
FIG. 5 is a third schematic diagram of a pixel circuit provided by an embodiment of the present disclosure.

As illustrated in FIG. 5, compared with the first embodiment, the pixel circuit 10 provided by the present embodiment further comprises: a second light-emitting control circuit 170 configured for controlling ON and OFF of the light-emitting circuit 110; and a second light-emitting control terminalsecond light-emitting control terminal EM2 configured for providing a signal that controls ON and OFF of the second light-emitting control circuit 170.

Figure 6:
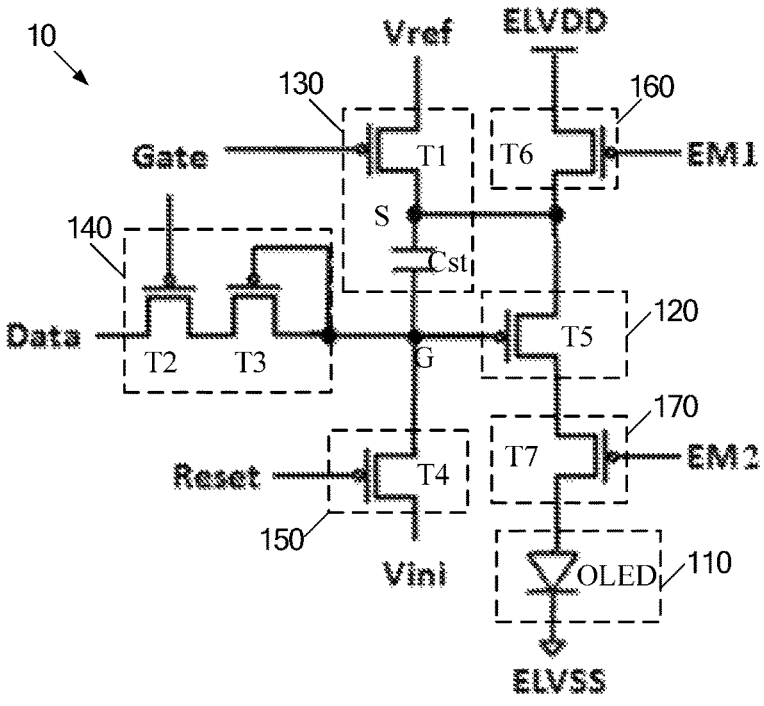
FIG. 6 is a fourth schematic diagram of a pixel circuit provided by an embodiment of the present disclosure.

For example, as illustrated in FIG. 6, in the pixel circuit 10 provided by the embodiment of the present disclosure, the compensating circuit 130 comprises a first transistor T1 and a storage capacitor Cst; the data writing circuit 140 comprises a second transistor T2 and a third transistor T3 connected in series; the reset circuit 150 comprises a fourth transistor T4; the driving circuit 120 comprises a fifth transistor T5; the first light-emitting control circuit 160 comprises a sixth transistor T6; the second light-emitting control circuit 170 comprises a seventh transistor T7; and the light-emitting circuit 110 comprises an OLED.

For example, with the second light-emitting control circuit 170 and the second light-emitting control terminalsecond light-emitting control terminal EM2, the degradation of display effect resulted by the light illumination phenomenon, which may occur during the time period other than the light emitting time period of the OLED, of the driving circuit 120 can be avoided.

Figure 7:
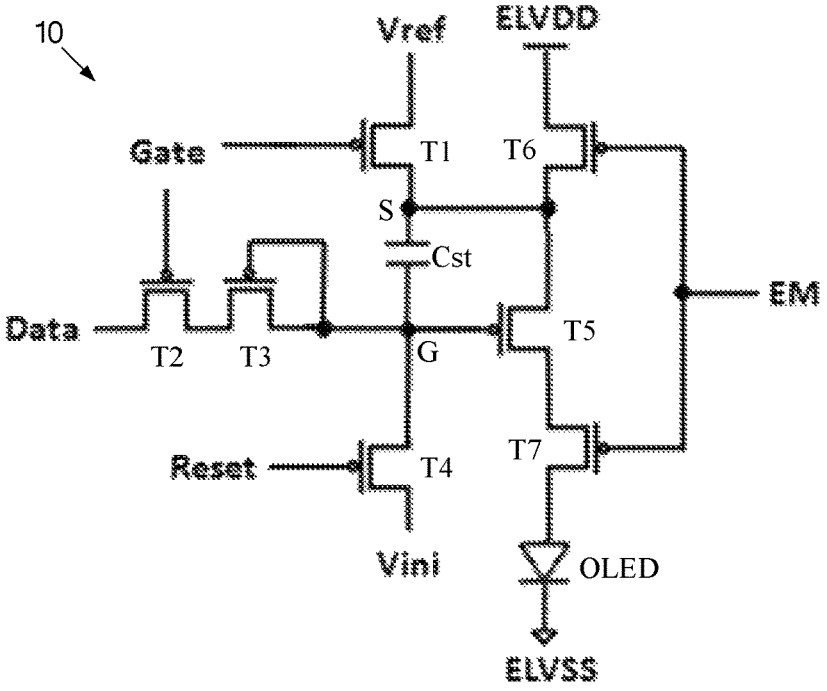
FIG. 7 is a fifth schematic diagram of a pixel circuit provided by an embodiment of the present disclosure.

For example, as illustrated in FIG. 7, in the pixel circuit 10 provided by the embodiment of the present disclosure, the first light-emitting control terminal EM1 and the second light-emitting control terminal EM2 are electrically connected with each other. For example, both the first light-emitting control terminal EM1 and the second light-emitting control terminal EM2 are electrically connected with the light-emitting control terminal EM.

Figure 8:
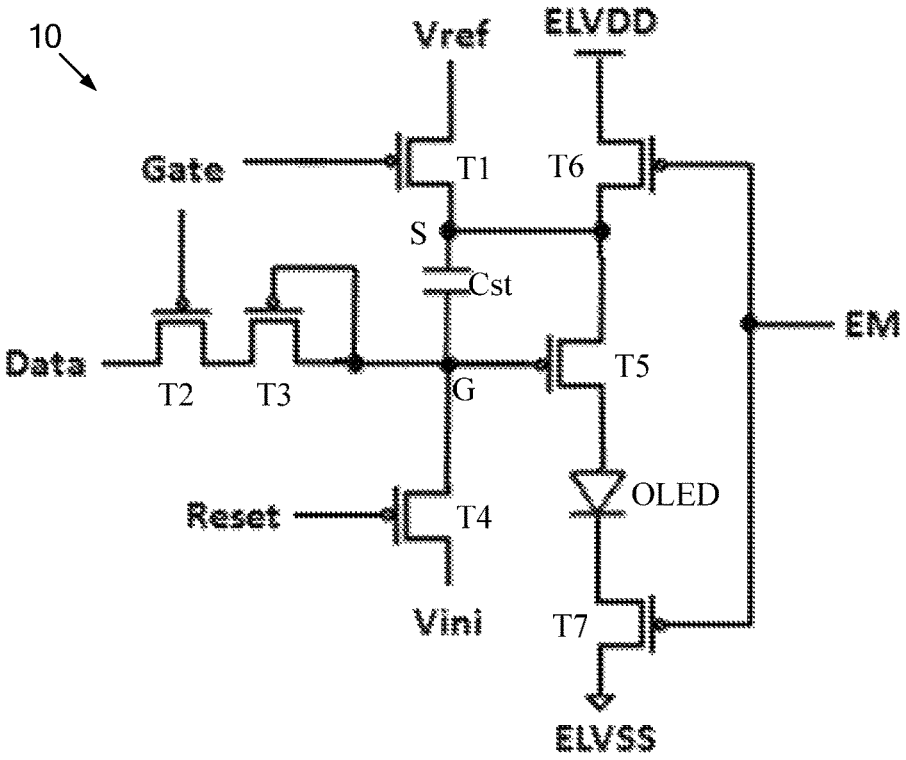
FIG. 8 is a sixth schematic diagram of a pixel circuit provided by an embodiment of the present disclosure.

For example, as illustrated in FIG. 7 and FIG. 8, in the pixel circuit 10 provided by the embodiment of the present disclosure, a source of the first transistor T1 is electrically connected with the reference voltage terminal Vref, a gate of the first transistor T1 is electrically connected with the scan control terminal (Gate), a drain of the first transistor T1 is electrically connected with a first node S; a source of the second transistor T2 is electrically connected with the data signal terminal (Data), a gate of the second transistor T2 is electrically connected with the scan control terminal (Gate), and a drain of the second transistor T2 is electrically connected with a source of the third transistor T3; a gate of the third transistor T3 is electrically connected with a drain of the third transistor T3, and the drain of the third transistor T3 is electrically connected with a second node G; a source of the fourth transistor T4 is electrically connected with the reset voltage terminal Vini, a gate of the fourth transistor T4 is electrically connected with the reset control terminal (Reset), and a drain of the fourth transistor T4 is electrically connected with the second node G; a source of the fifth transistor T5 is electrically connected with the first node S, and a gate of the fifth transistor T5 is electrically connected with the second node G; a source of the sixth transistor T6 is electrically connected with the first voltage terminal ELVDD, a gate of the sixth transistor T6 is electrically connected with the first light-emitting control terminal EM1, and a drain of the sixth transistor T6 is electrically connected with the first node S; a first terminal of the storage capacitor Cst is electrically connected with the first node S, and a second terminal of the storage capacitor Cst is electrically connected with the second node G; as illustrated in FIG. 7, a source of the seventh transistor T7 is electrically connected with a drain of the fifth transistor T5, a gate of the seventh transistor T7 is electrically connected with the second light-emitting control terminal EM2, a first terminal of the OLED is electrically connected with a drain of the seventh transistor T7, and a second terminal of the OLED is electrically connected with the second voltage terminal ELVSS; or as illustrated in FIG. 8, a first terminal of the OLED is electrically connected with a drain of the fifth transistor T5, a second terminal of the OLED is electrically connected with a source of the seventh transistor T7, a gate of the seventh transistor T7 is electrically connected with the second light-emitting control terminal EM2, and a drain of the seventh transistor T7 is electrically connected with the second voltage terminal ELVSS. That is, the position of the OLED and the seventh transistor T7 can be exchanged, and the present embodiment is not limited by the position of the OLED and the seventh transistor T7.

For example, in the pixel circuit provided by the embodiment of the present disclosure, a threshold voltage of the third transistor T3 and a threshold voltage of the fifth transistor T5 are equal to each other.

For example, in the pixel circuit provided by the embodiment of the present disclosure, the first transistor T1, the second transistor T2, the third transistor T3, the fourth transistor T4, the fifth transistor T5, the sixth transistor T6 and the seventh transistor T7 are thin-film transistors or field effect transistors.

For example, in the pixel circuit provided by the embodiment of the present disclosure, the first transistor T1, the second transistor T2, the third transistor T3, the fourth transistor T4, the fifth transistor T5, the sixth transistor T6 and the seventh transistor T7 are P-type transistors.

It should be understood that the embodiment of the present disclosure comprises but not limited to the following case, that is, the first transistor T1, the second transistor T2, the third transistor T3, the fourth transistor T4, the fifth transistor T5, the sixth transistor T6 and the seventh transistor T7 are P-type transistors, part of or all of the transistors can also be N-type transistors, and the specific structures of the transistors can be chosen according to actual demands, and the structure and/or the driving method of the pixel circuit can be modified accordingly.

Figure 9:
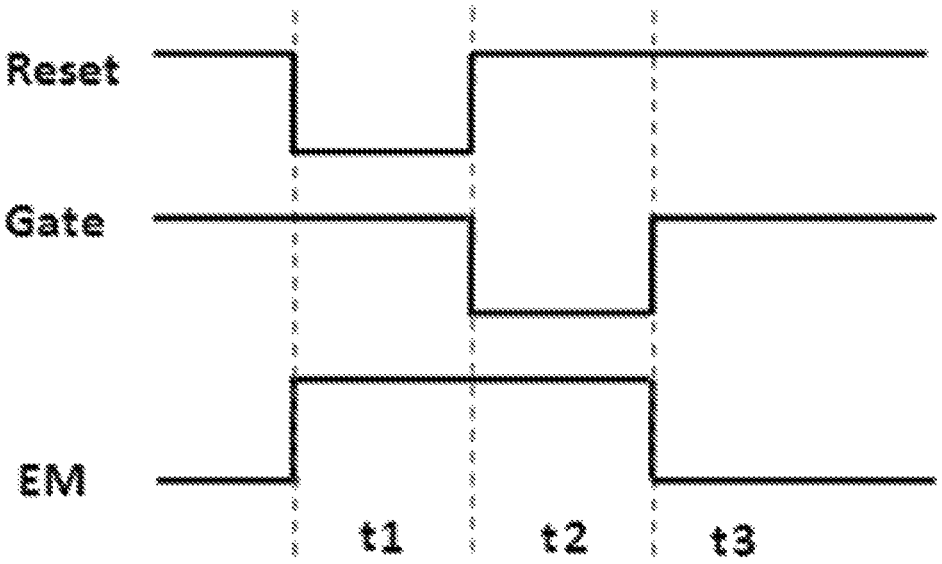
FIG. 9 is a driving timing diagram of the pixel circuit, which is provided by the embodiment of the present disclosure and illustrated in FIG. 7 or FIG. 8.

For example, the embodiment of the present disclosure further provides a driving method for the pixel circuit; the following descriptions are based on the pixel circuit as illustrated in FIG. 7. FIG. 9 is a driving timing diagram, provided by the embodiment of the present disclosure, of the pixel circuit as illustrated in FIG. 7 or FIG. 8. As illustrated in FIG. 9, the driving method comprises a resetting phase t1, a threshold compensating and data writing phase t2, and an IR drop compensating and light emitting phase t3.

For example, in the driving method provided by the embodiment of the present disclosure, during the resetting phase t1, the reset control terminal (Reset) outputs a valid signal, the scan control terminal (Gate) outputs an invalid signal, the first light-emitting control terminal EM1 and the second light-emitting control terminal EM2 outputs an invalid signal, that is, the light-emitting terminal EM outputs an invalid signal.

For example, in the driving method provided by the embodiment of the present disclosure, during the threshold compensating and data writing phase t2, the reset control terminal (Reset) outputs an invalid signal, the scan control terminal (Gate) outputs a valid signal, the first light-emitting control terminal EM1 and the second light-emitting control terminal EM2 outputs an invalid signal, that is, the light-emitting terminal EM outputs an invalid signal.

For example, in the driving method provided by the embodiment of the present disclosure, during the IR drop compensating and light emitting phase t3, the reset control terminal (Reset) outputs an invalid signal, the scan control terminal (Gate) outputs an invalid signal, the first light-emitting control terminal EM1 and the second light-emitting control terminal EM2 outputs a valid signal, that is, the light-emitting terminal EM outputs an valid signal.

The meaning of the terms valid signal and invalid signal can refer to the descriptions of the first embodiment; no further descriptions will be given here.

For example, refer to FIG. 7 and FIG. 9, during the resetting phase t1, the reset control terminal (Reset) outputs a valid signal and therefore makes the fourth transistor T4 be turned on; the scan control terminal (Gate) outputs an invalid signal and therefore the first transistor T1 and the second transistor T2 are turned off; the light-emitting control terminal EM outputs an invalid signal and therefore the sixth transistor T6 and the seventh transistor T7 are turned off. Because the fourth transistor T4 is turned on, the reset voltage terminal Vini is electrically connected with the second node G via the fourth transistor T4, and the voltage of the second node G is equal to the resetting voltage Vvini provided by the reset voltage terminal, i.e., the voltage of the second terminal of the storage capacitor Cst of the compensating circuit 130 is Vvini, and the voltage of the gate of the fifth transistor T5 of the driving circuit 120 is Vvini, that is, the reset circuit 150 resets the compensating circuit 130 and the driving circuit 120 during the resetting phase t1. Because the seventh transistor T7 is turned off, the light illumination phenomenon, which can be caused by the leakage current of the fifth transistor T5, of the OLED can be avoided.

For example, during the threshold compensating and data writing phase t2, the reset control terminal (Reset) outputs an invalid signal, and therefore the fourth transistor T4 is turned off; the scan control terminal (Gate) outputs a valid signal, and therefore makes the first transistor T1 and the second transistor T2 be turned on; the light-emitting control terminal EM outputs an invalid signal and therefore the sixth transistor T6 and the seventh transistor T7 are turned off. Because the first transistor T1 is turned on, the reference voltage terminal Vref is electrically connected with the first node S via the first transistor T1, and the voltage of the first node S is equal to the compensating voltage Vvref provided by the reference voltage terminal, i.e., the voltage of the first terminal of the storage capacitor Cst of the compensating circuit 130 is Vvref. Because the second transistor T2 is turned on, the data signal terminal (Data) is electrically connected with the second node G via the second transistor T2 and the third transistor T3; in addition, because the gate of the third transistor T3 is electrically connected with the drain of the third transistor T3, the third transistor T3 functions as a diode; therefore, the voltage of the second node G is equal to the sum of the voltage Vdata of the data signal terminal (Data) and the threshold voltage Vth of the third transistor T3, that is, the voltage of the second terminal of the storage capacitor Cst of the compensating circuit 130 is Vdata+Vth, and the voltage of the gate of the fifth transistor T5 of the driving circuit 120 is Vdata+Vth. It should be understood that the voltage of the second node G during the previous phase (resetting phase t1) is equal to the resetting voltage Vvini provided by the reset voltage terminal, and the voltage of the second node G should satisfy the requirement, Vvini−Vth<Vdata. Thereby, during the threshold compensating and data writing phase t2, the data writing circuit 140 writes data to the driving circuit 120, and therefore, the threshold voltage compensation is realized; here the voltage difference between the first terminal and the second terminal of the storage capacitor Cst is Vdata+Vth-Vvref. For example, in a case that both the threshold voltage of the third transistor T3 and the threshold voltage of the fifth transistor T5 are equal to Vth, the effect of threshold voltage compensation can be improved. Because the seventh transistor T7 is turned off, the light illumination phenomenon, which can be caused by the leakage current of the fifth transistor T5, of the OLED can be avoided.

For example, during the IR drop compensating and light emitting phase t3, the reset control terminal (Reset) outputs an invalid signal, and therefore the fourth transistor T4 is turned off; the scan control terminal (Gate) outputs an invalid signal, and therefore the first transistor T1 and the second transistor T2 are turned off; the light-emitting control terminal EM outputs a valid signal, and therefore makes the sixth transistor T6 and the seventh transistor T7 be turned on. An electrical path is formed through the first voltage terminal ELVDD, the sixth transistor T6, the fifth transistor T5, the seventh transistor T7, the OLED and the second voltage terminal ELVSS, and the OLED of the light-emitting circuit 110 is emitting light by means of the light-emitting voltages provided by the first voltage terminal ELVDD and the second voltage terminal ELVSS (the first voltage terminal ELVDD provides a first light-emitting voltage Velvdd, and the second voltage terminal ELVSS provides a second light-emitting voltage Velvss) and under the driving of the fifth transistor T5 of the driving circuit 120. Because the sixth transistor T6 is turned on, the first voltage terminal ELVDD is electrically connected with the first node S via the sixth transistor T6, and the voltage of the first node S is changed to a first light-emitting voltage Velvdd provided by the first voltage terminal ELVDD, that is, the voltage of the first terminal of the storage capacitor Cst is Velvdd, and the voltage of the source of the fifth transistor T5 is Velvdd. Because of the self-lifting effect of the storage capacitor Cst, that is, in the case that the electric charge stored by the storage capacitor Cst is not changed, the change of the voltage of the first terminal can result in the change of the voltage of the second terminal, and the voltage difference between the second terminal and the first terminal of the storage capacitor Cst remains the same, the voltage of the second terminal of the storage capacitor Cst is changed to the sum of the voltage Velvdd of the first terminal of the storage capacitor Cst and the voltage difference Vdata+Vth−Vvref between the second terminal and the first terminal of the storage capacitor Cst during the previous phase (threshold compensating and data writing phase t2), that is, the voltage of the second node G is equal to Velvdd+Vdata+Vth−Vvref, and the voltage of the source of the fifth transistor T5 is equal to Velvdd+Vdata+Vth−Vvref. Therefore, the gate-source voltage Vgs (i.e., the voltage difference between the voltage of the gate and the voltage of the source of the fifth transistor T5) of the fifth transistor T5 is satisfying the following equation:

$$Vgs = Velvdd + V\text{data} + Vth - V\text{vref} - Velvdd = V\text{data} + Vth - V\text{vref}$$

The OLED is in saturation state in normal operation, and the driving current holed flowing through the OLED is satisfying the following equation:

$$Ioled = 0.5\mu_n Cox\frac{W}{L}(Vgs - Vth)^2$$

where μn is the channel mobility of the fifth transistor T5, Cox is the channel capacitance per unit area of the fifth transistor T5, W and L are the channel width and the channel length of the fifth transistor T5, respectively.

According to the previous calculation result, $$Vgs - Vth = V\text{data} + Vth - V\text{vref} - Vth = V\text{data} - V\text{vref}$$

and therefore, $$Ioled = 0.5\mu_n Cox\frac{W}{L}(Vgs - Vth)^2 = 0.5\mu_n Cox\frac{W}{L}(Vdata - Vvref)^2$$

Based on the above equation, the driving current Ioled flowing through the OLED is irrelevant to all the threshold voltage Vth of the fifth transistor T5, the first light-emitting voltage Velvdd provided by the first voltage terminal ELVDD and the second light-emitting voltage Velvss provided by the second voltage terminal ELVSS; and the driving current Ioled is only relevant to the voltage Vdata of the data signal terminal (Data) and the compensating voltage Vvref provided by the reference voltage terminal Vref; and thus the driving current Ioled transmitted through the OLED is a constant value as long as the voltage different between the voltage Vdata of the data signal terminal (Data) and the compensating voltage Vvref provided by the reference voltage terminal Vref is a constant value. Therefore, the threshold voltage and IR drop can be compensated, the homogeneity of driving current can be increased, and the homogeneity of displayed images of the display panel can be accordingly increased.

It should be understood that the content of the second embodiment, which is similar to the first embodiment, can refer to the first embodiment, no further descriptions will be given here.

Third Embodiment

Figure 10:
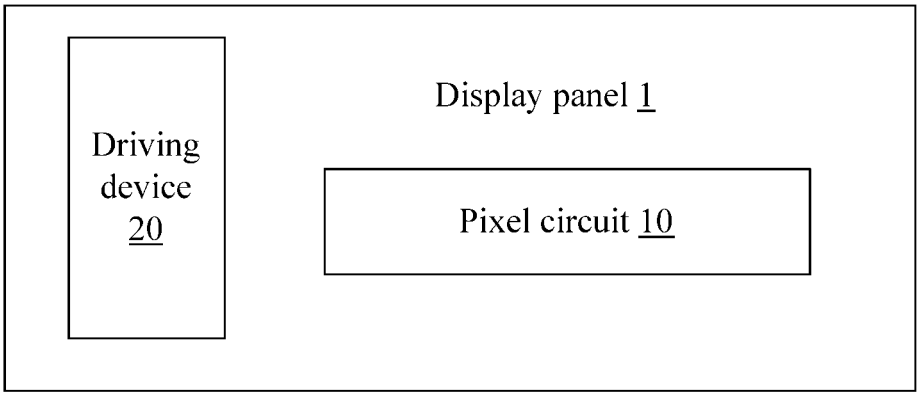
FIG. 10 is a schematic diagram of a display panel provided by an embodiment of the present disclosure.

For example, as illustrated in FIG. 10, the embodiment of the present disclosure further provides a display panel 1, which comprises the pixel circuit 10 of any ne of the embodiments of the present disclosure, and a driving device 20.

For example, the display panel 1 can comprises pixel circuits 10 arranged in an array.

For example, the display panel 1 provided by the embodiment of the present disclosure can further comprise the driving device 20, the driving device 20 can be integrated in the circuits of the display panel 1; alternatively, the driving device 20 (for example, a driving IC) can also be manufactured separately and then mounted on the substrate of the display panel 1. For example, the driving device can be a dedicated hardware device, which configured for realizing the driving method provided by any one of the embodiments of the present disclosure. For example, the driving device can be configured for generating the driving waveforms of the resetting phase t1, the threshold compensating and data writing phase t2, and the IR drop compensating and light emitting phase t3 of the driving method provided by any one of the embodiments of the present disclosure. For example, the dedicated hardware device can be PLC, FPGA, ASIC, DSP or other programmable logic control device. For another example, the driving device can be a circuit board or a combination of a plurality of circuit boards, configured for realizing the above driving method. In the embodiment of the present disclosure, the circuit board or the combination of the plurality of circuit boards can comprise: (1) one or more processor; (2) one or more non-transitory computer readable storage connected to the processor; and/or (3) firmware stored in storage.

The display panel provided by the embodiment of the present disclosure can be applied in any products or components that have display function, such as a cell phone, a tablet computer, a television, a display screen, a laptop, a digital photo frame and a navigator.

Embodiment of the present disclosure provides a pixel circuit, a display panel and a driving method, IR drop and threshold voltage of the display panel can be compensated, the homogeneity of driving current can be increased, and the homogeneity of displayed images of the display panel can be accordingly increased.

Even though the present disclosure is detailed described with general descriptions and specific implementation methods, it is apparent for those skilled in the art that modifications and improvements can be made based on the embodiments of the present disclosure. Therefore, modifications and improvements without departing from the spirit and scope of the present disclosure should be intended to fall into the scope of the present disclosure.

The present application claims priority to the Chinese patent application No. 201610407475.1, filed Jun. 12, 2016, the entire disclosure of which is incorporated herein by reference as part of the present application.

What is claimed is:

1. A pixel circuit, comprising:

a light-emitting circuit configured for emitting light during a working period;

a driving circuit configured for driving the light-emitting circuit;

a compensating circuit configured for compensating the driving circuit;

a data writing circuit configured for writing data to the driving circuit;

a reset circuit configured for resetting the compensating circuit and the driving circuit;

a first light-emitting control circuit configured for controlling ON and OFF of the light-emitting circuit;

a first voltage terminal and a second voltage terminal configured for providing light-emitting voltages for the light-emitting circuit;

a reset voltage terminal configured for providing a resetting voltage for the reset circuit;

a reference voltage terminal configured for providing a compensating voltage for the compensating circuit;

a scan control terminal, electrically connected with the compensating circuit and the data writing circuit and configured for providing a signal that controls ON and OFF of the compensating circuit and the data writing circuit;

a data signal terminal configured for providing a data signal for the data writing circuit;

a reset control terminal configured for providing a signal that controls ON and OFF of the reset circuit; and a first light-emitting control terminal configured for providing a signal that controls ON and OFF of the first light-emitting control circuit, wherein, the compensating circuit comprises a first transistor and a storage capacitor connected in series, the data writing circuit comprises a second transistor and a third transistor connected in series, the reset circuit comprises a fourth transistor, the driving circuit comprises a fifth transistor, the first light-emitting control circuit comprising a sixth transistor, and the light-emitting circuit comprising an organic light-emitting diode.

2. The pixel circuit according to claim 1, wherein, a source of the first transistor is electrically connected with the reference voltage terminal, a gate of the first transistor is electrically connected with the scan control terminal, and a drain of the first transistor is electrically connected with a first node;

a source of the second transistor is electrically connected with the data signal terminal, a gate of the second transistor is electrically connected with the scan control terminal, and a drain of the second transistor is electrically connected with a source of the third transistor;

a gate of the third transistor is electrically connected with a drain of the third transistor, and the drain of the third transistor is electrically connected with a second node;

a source of the fourth transistor is electrically connected with the reset voltage terminal, a gate of the fourth transistor is electrically connected with the reset control terminal, and a drain of the fourth transistor is electrically connected with the second node;

a source of the fifth transistor is electrically connected with the first node, and a gate of the fifth transistor is electrically connected with the second node;

a source of the sixth transistor is electrically connected with the first voltage terminal, a gate of the sixth transistor is electrically connected with the first light-emitting control terminal, and a drain of the sixth transistor is electrically connected with the first node;

a first terminal of the storage capacitor is electrically connected with the first node, and a second terminal of the storage capacitor is electrically connected with the second node; and a first terminal of the organic light-emitting diode is electrically connected with a drain of the fifth transistor, and a second terminal of the organic light-emitting diode is electrically connected with the second voltage terminal.

3. The pixel circuit according to claim 1, further comprising:

a second light-emitting control circuit configured for controlling ON and OFF of the light-emitting circuit; and a second light-emitting control terminal configured for providing a signal that controls ON and OFF of the second light-emitting control circuit.

4. The pixel circuit according to claim 3, wherein the first light-emitting control terminal and the second light-emitting control terminal are electrically connected with each other.

5. The pixel circuit according to claim 3, wherein the second light-emitting control circuit comprises a seventh transistor.

6. The pixel circuit according to claim 5, wherein, a source of the first transistor is electrically connected with the reference voltage terminal, a gate of the first transistor is electrically connected with the scan control terminal, and a drain of the first transistor is electrically connected with a first node;

a source of the second transistor is electrically connected with the data signal terminal, a gate of the second transistor is electrically connected with the scan control terminal, and a drain of the second transistor is electrically connected with a source of the third transistor;

a gate of the third transistor is electrically connected with a drain of the third transistor, and the drain of the third transistor is electrically connected with a second node;

a source of the fourth transistor is electrically connected with the reset voltage terminal, a gate of the fourth transistor is electrically connected with the reset control terminal, and a drain of the fourth transistor is electrically connected with the second node;

a source of the fifth transistor is electrically connected with the first node, and a gate of the fifth transistor is electrically connected with the second node;

a source of the sixth transistor is electrically connected with the first voltage terminal, a gate of the sixth transistor is electrically connected with the first light-emitting control terminal, and a drain of the sixth transistor is electrically connected with the first node;

a first terminal of the storage capacitor is electrically connected with the first node, and a second terminal of the storage capacitor is electrically connected with the second node; and a source of the seventh transistor is electrically connected with a drain of the fifth transistor, a gate of the seventh transistor is electrically connected with the second light-emitting control terminal, a first terminal of the organic light-emitting diode is electrically connected with a drain of the seventh transistor, and a second terminal of the organic light-emitting diode is electrically connected with the second voltage terminal; or, a first terminal of the organic light-emitting diode is electrically connected with a drain of the fifth transistor, a second terminal of the organic light-emitting diode is electrically connected with a source of the seventh transistor, a gate of the seventh transistor is electrically connected with the second light-emitting control terminal, and a drain of the seventh transistor is electrically connected with the second voltage terminal.

7. The pixel circuit according to claim 5, wherein the first transistor, the second transistor, the third transistor, the fourth transistor, the fifth transistor, the sixth transistor, and the seventh transistor are thin-film transistors.

8. The pixel circuit according to claim 5, wherein the first transistor, the second transistor, the third transistor, the fourth transistor, the fifth transistor, the sixth transistor, and the seventh transistor are P-type transistors.

9. The pixel circuit according to claim 5, wherein a threshold voltage of the third transistor and a threshold voltage of the fifth transistor are equal to each other.

10. A driving method for the pixel circuit according to claim 3, comprising a resetting phase, a threshold compensating and data writing phase, and an IR drop compensating and light emitting phase.

11. The driving method according to claim 10, wherein, during the resetting phase, the reset control terminal outputs a valid signal, the scan control terminal outputs an invalid signal, and the first light-emitting control terminal and the second light-emitting control terminal outputs an invalid signal.

12. The driving method according to claim 10, wherein, the threshold compensating and data writing phase, the reset control terminal outputs an invalid signal, the scan control terminal outputs a valid signal, and the first light-emitting control terminal and the second light-emitting control terminal outputs an invalid signal.

13. The driving method according to claim 10, wherein, during the IR drop compensating and light emitting phase, the reset control terminal outputs an invalid signal, the scan control terminal outputs an invalid signal, and the first light-emitting control terminal and the second light-emitting control terminal outputs a valid signal.

14. The pixel circuit according to claim 1, wherein a threshold voltage of the third transistor and a threshold voltage of the fifth transistor are equal to each other.

15. A display panel, comprising the pixel circuit according to claim 1.

16. A driving method for the pixel circuit according to claim 1, comprising a resetting phase, a threshold compensating and data writing phase, and an IR drop compensating and light emitting phase.

17. The driving method according to claim 16, wherein, during the resetting phase, the reset control terminal outputs a valid signal, the scan control terminal outputs an invalid signal, and the first light-emitting control terminal outputs an invalid signal.

18. The driving method according to claim 16, wherein, during the threshold compensating and data writing phase, the reset control terminal outputs an invalid signal, the scan control terminal outputs a valid signal, and the first light-emitting control terminal outputs an invalid signal.

19. The driving method according to claim 16, wherein, during the IR drop compensating and light emitting phase, the reset control terminal outputs an invalid signal, the scan control terminal outputs an invalid signal, and the first light-emitting control terminal outputs a valid signal.

* * * * *